US005484167A

United States Patent [19]

Donaldson et al.

[11] Patent Number: 5,484,167

[45] Date of Patent: Jan. 16, 1996

[54] LABEL HAVING INTEGRALLY FORMED DIFFERENTIAL RELEASE COUPON AND METHOD OF MAKING

[75] Inventors: Dean S. Donaldson, Vallejo; Darren T. Williams, Brentwood; William W. Campbell, Benicia, all of Calif.

[73] Assignee: The Clorox Company, Oakland, Calif.

[21] Appl. No.: 120,891

[22] Filed: Sep. 13, 1993

[51] Int. Cl.[6] ..... B42D 15/00

[52] U.S. Cl. ..... 283/67; 283/81; 283/103; 283/105; 40/310; 428/43

[58] Field of Search ..... 283/51, 79, 81, 283/100, 103, 105, 108, 109, 67; 40/310; 428/40, 916, 43

[56] References Cited

U.S. PATENT DOCUMENTS

| | | | |
|---|---|---|---|
| 814,592 | 3/1906 | Duane | 283/103 X |
| 3,110,121 | 11/1963 | Corrinet . | |
| 3,917,276 | 11/1975 | Green Barg | 283/903 X |
| 3,927,484 | 12/1975 | Spiegel et al. | 40/307 |
| 3,982,686 | 9/1976 | Parlour et al. | 229/70 X |
| 3,994,089 | 11/1976 | Schwartz | 40/310 |
| 4,306,367 | 12/1981 | Otto . | |
| 4,308,679 | 1/1982 | Ray, III et al. . | |
| 4,345,393 | 8/1982 | Price et al. . | |
| 4,498,581 | 2/1985 | Dutcher | 206/427 |
| 4,880,964 | 11/1989 | Donahue | 283/903 X |
| 5,007,578 | 4/1991 | Simone | 229/1.5 B |
| 5,078,273 | 1/1992 | Kuchenbecker | 229/207 |
| 5,172,936 | 12/1992 | Sullivan et al. | 283/81 |
| 5,324,559 | 6/1994 | Brombacher | 283/81 X |

*Primary Examiner*—Frances Han
*Attorney, Agent, or Firm*—Michael J. Mazza

[57] ABSTRACT

A label is formed onto packaging substrate and has a differential release coupon portion formed integrally therein. The packaging substrate is generally a label substrate such as a plastic, metal foil or paper as known in the art. The differential release coupon is defined by a tear outline consisting of a first arcuate section comprising a continuous radius cut; a second section comprising a plurality of overlapping, outwardly extending herringbone cuts defining a first taper; a third section comprising a plurality of straight cuts; a fourth section comprising overlapping vertical hash cuts defining a second taper; and transition cuts intermediate to the second and third sections and intermediate to the third and fourth sections. The tear pattern results in a coupon which is easily released in a single motion, and which leaves the remaining label intact, preserving valuable product information. The coupon is of a size and shape to facilitate redemption and handling by retail personnel.

13 Claims, 2 Drawing Sheets

LABEL HAVING INTEGRALLY FORMED DIFFERENTIAL RELEASE COUPON AND METHOD OF MAKING

BACKGROUND OF THE INVENTION

1. Field of the Invention

The present invention relates to packaging labels having removable sections and, in particular, to a packaging label having a removable section with differential release characteristics.

2. Description of Related Art

Mass merchandised packaged goods, typically consumer commodities such as household cleaning products, foods, personal and home care products, and the like, rely heavily on promotional techniques to gain a competitive advantage in the marketplace. Package and label designs, the use of trademarks, logos and slogans, and the use of redeemable coupons are commonly employed in this regard. Coupons which are redeemable for discounts or premiums offer significant incentives to consumers. Such coupons most commonly are found in a secondary source, e.g. a newspaper or magazine, or are directly mailed to the consumer, and must be clipped out by the consumer and brought into the store, where they are redeemed at the point of sale with the purchased item. A recent development to overcome the disadvantages inherent in this type of coupon practice is the instant redeemable coupon, which is affixed to the product itself and removed and redeemed at the point of purchase by the consumer. Instant redeemable coupons are generally of three types: secondary label coupons; externally dispensed coupons (i.e. in-store hang tags); and removable coupon sections of existing packaging labels. External coupons require in-store coupon machines for their distribution. Secondary label coupons, e.g., neck bands and hangers or peel-off stickers, suffer from the disadvantage of requiring additional packaging equipment to affix the label, and, further, a great many products are packaged in such a way that there is insufficient additional room for a separate label. The coupons themselves should have minimum dimensions to facilitate handling by the consumer and cashier. These coupons also must be affixed in such a manner as to be removed easily by the consumer or cashier, yet must not be so susceptible to release that they will fall off the package during manufacturing, handling or stocking. Accordingly, the use of a removable coupon section of an existing label would be preferable; however, the prior art has not yielded a commercially viable coupon. These efforts include free-hanging label extensions and intricate perforation patterns, which have not taken into account variations in substrate and grain pattern. These efforts also have not addressed the need for easy handling and label integrity. Most salient is the need to develop a removable coupon which is readily removed by the consumer, yet which will similarly not prematurely come off during manufacturing, shipping or handling of the product. An additional problem which needs to be overcome in this type of label is the need to ensure the non-removable portion of the label remains securely affixed to the package while the coupon portion is removed, and further that the non-removable label portion remains firmly affixed to the package during subsequent handling so that valuable product usage, handling and/or safety information is preserved. All of these types of coupons must also be of a sufficient size, generally at least about 5×9 cm., to allow redemption value and information to be printed thereupon and also to be easily handled by both the consumer and the store clerks redeeming the coupons.

Ray, III et al., U.S. Pat. No. 4,308,679, is typical of the art relating to instant redeemable coupons and describes a laminated structure having a label which is adhesively coated about its entire inner surface, and a peel-off panel with a predetermined tear-out line and an adhesive repellant means provided on the peel-off portion. Otto, U.S. Pat. No. 4,306,367, also describes a laminated peel-off layer having an adhesively affixed label which is water soluble, thus permitting release of the peelable portion by application of water thereto. Price et al., U.S. Pat. No. 4,346,393, similarly describes a peelable on-package coupon having either a release agent or having multiple plies such that the peelable portion removes a portion of the adhesive ply. Corrinet, U.S. Pat. No. 3,110,121, claims a multi-ply container having an adhesively-secured label having a peelable portion thereof with a waxy adhesive resist.

In view of the prior art, there remains a need for a label having an integral coupon which is easily removable and is easily handled by both the consumer and the retail clerks, and which does not require any modification of existing packages or labeling.

It is therefore an object of the present invention to provide a label having a removable coupon portion which resists unintentional removal yet can be readily and easily removed at the point of sale.

It is a further object of the present invention to provide a coupon which is easily separable from the package label, allowing the label to remain securely affixed to the package during coupon removal and thereafter.

It is yet another object of the present invention to provide a label having a removable coupon portion thereof and wherein the label is not required to be adhesively laminated to the container.

It is another object of the present invention to provide a coupon which, once removed, is easily handled, redeemed, stored and submitted for redemption.

It is a further object of the present invention to provide a coupon which can be printed on both sides.

SUMMARY OF THE INVENTION

In one embodiment, the present invention comprises a label formed onto a label substrate and having a tear-off, releasable coupon portion formed integrally therein. The label substrate is generally a thin, pliant material such as a plastic, metal foil or paper as known in the art. The releasable coupon is defined by a perforated tear pattern consisting of a first arcuate section having a continuous radius cut; a second section having a plurality of overlapping, outwardly extending herringbone cuts; a third section having a plurality of straight cuts; a fourth section having a plurality of overlapping vertical hash cuts; and transition cuts intermediate to the second and third sections and intermediate to the third and fourth sections.

It is therefore an advantage of the present invention that the coupon is sufficiently strong to resist unintentional removal during manufacturing, shipping, handling and storing of the product and container to which the label is affixed.

It is a further advantage of the present invention that the coupon is readily and easily removed by the consumer with a single continuous uniform motion.

It is another advantage of the present invention that the redeemed coupon is readily and easily handled by retail personnel.

It is yet another advantage of the present invention that the releasable coupon portion of the label cleanly separates from the remaining portion of the label, leaving the label intact and securely attached to the package, and thus preserving valuable product, safety and use information.

It is yet another advantage of the present invention that the label may be affixed to the packaging using only a small amount of adhesive at opposing ends portions of the label, and adhesive is not required over the entire inner surface between the label and the packaging.

It is yet another advantage of the present invention that the label and releasable coupon portion thereof are well suited to affixing to packaging having a cylindrical cross-section and which can have a wide range of diameters.

These and other objects and advantages of the present invention will no doubt become apparent to one skilled in the art, after having read the following detailed description of the preferred embodiment.

DETAILED DESCRIPTION OF THE PREFERRED EMBODIMENT

In the Drawings

Figure 1:
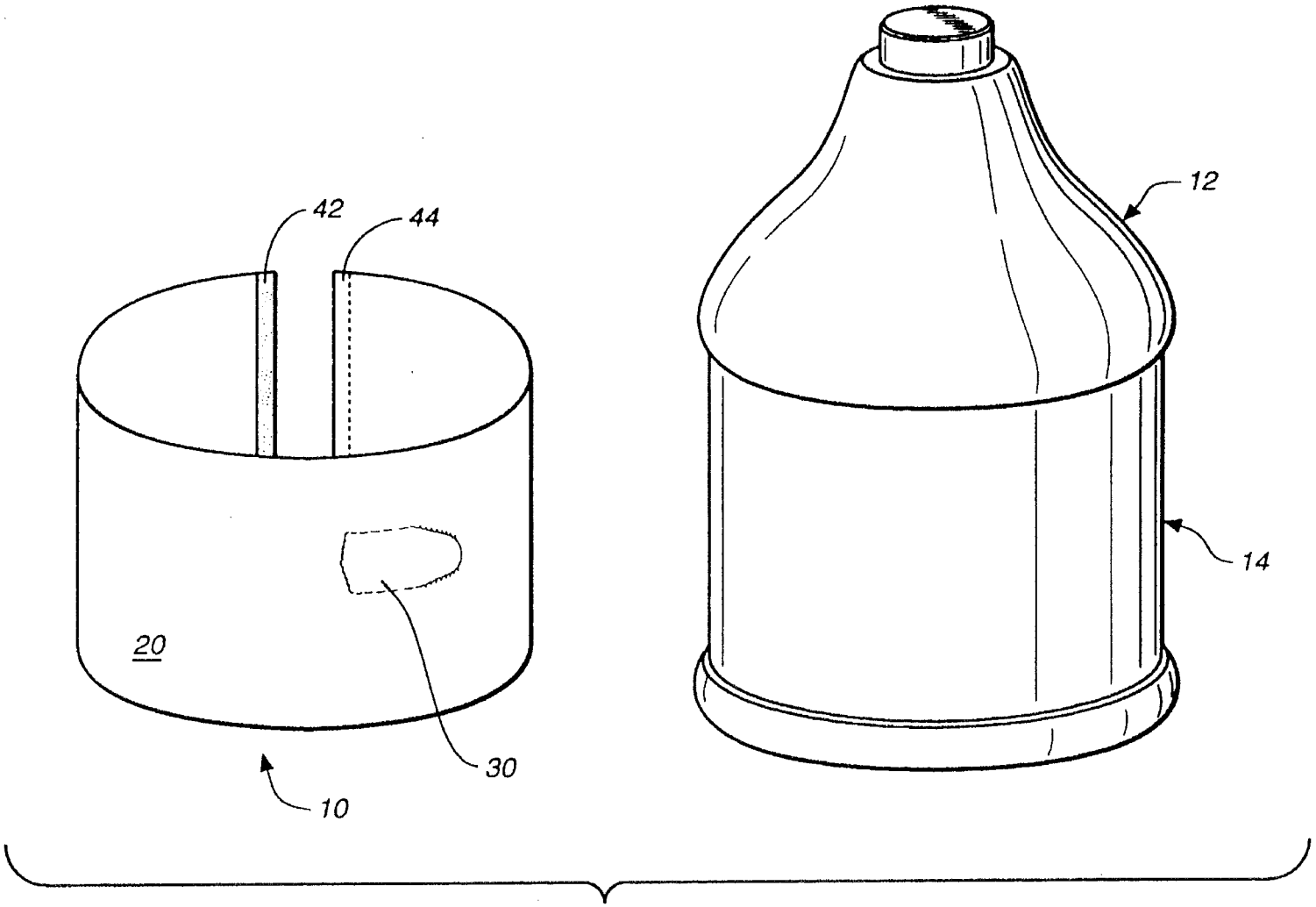
Figure 2:
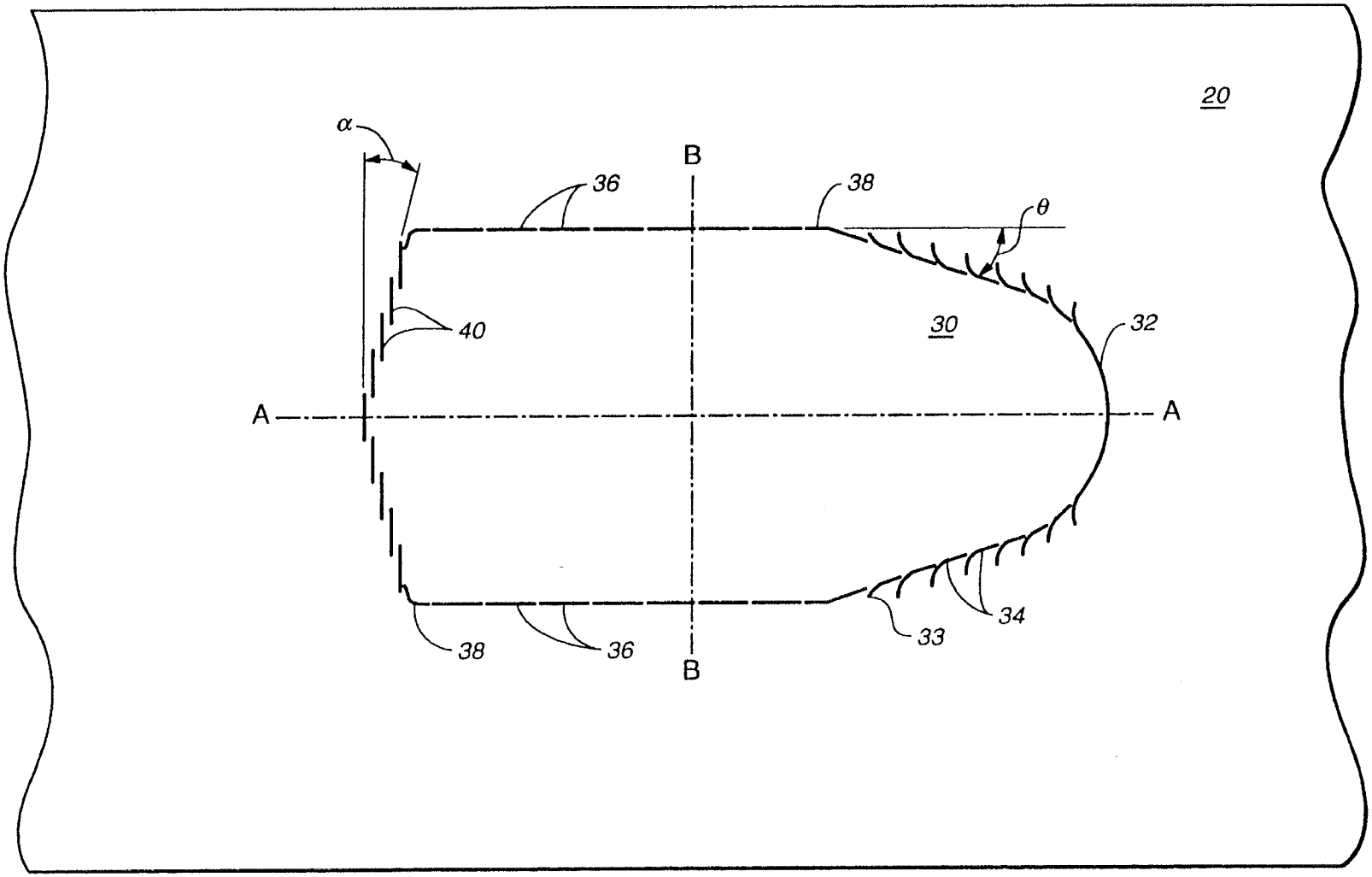

FIG. 1 is a perspective view of a container having a cylindrical section and the label and removable coupon of the present invention detached from the container; and FIG. 2 is a top plan view of the label and removable coupon of the present invention.

FIGS. 1 and 2 illustrate a first embodiment of the label of the present invention and referred to by the general reference character 10. The label 10 includes a non-releasable fixed portion 20 which is affixed to the container 12, about the cylindrical portion thereof 14, and a releasable coupon portion 30. The coupon 30 is preferably symmetrical about center axis AA, along which the coupon 30 is to be torn. While the overall dimensions of coupon 30 are variable, in practice it is preferred that the coupon 30 be about 4–6 cm. wide and 8–12 cm. long to afford sufficient area for printing, and to facilitate handling. In the most preferred embodiment, the coupon 30 is about 5 cm. by 10 cm.

Coupon 30 comprises a continuous cut 32 which is arcuate, with a radius of approximately 1–3 cm. and about an arc of approximately 80–120 degrees, or 2–3 cm. in length. Preferably, the arc is about 90 degrees with a 2 cm. radius. The continuous cut 32 provides easy finger access for gripping the coupon 30 to allow its release from the fixed portion by tearing along axis AA. The amount of arc of continuous cut 32 is variable; however, it is preferred that the radius be relatively large to result in a squared-off shape for stacking the coupon 30 once removed and redeemed at the point of sale. The continuous cut 32 transitions to a plurality of overlapping herringbone cuts 34, and the ends of the continuous cut 32 coincide with the first herringbone cut 34 such that the continuous cut 32 terminates with a herringbone cut 34. Referring to FIG. 2, each herringbone cut 34 includes a flange 33 cut toward the outside of the coupon 30 (i.e. into the fixed label 20), thus allowing clean angle perforation tearing. The overlapping herringbone cuts 34 individually may range from about 2–6 mm., preferably about 4–6 mm., and the entire length thereof should be about 2–4 cm. for the preferred embodiment, or approximately 20–40% of the overall length of the coupon 30. An uncut portion of the label 10 between each herringbone cut 34 is about 10–30% of the length of the cut, and in the preferred embodiment, about 20% or 1 mm. It is important that each herringbone cut 34 extend to the outside of the coupon 30 toward the fixed portion 20, and each flange 33 must extend slightly beyond the beginning of the next cut 34 for optimal releasability. The flange 33 makes up about 20–50% of the overall length of the cut 34, and preferably about 30–40%. In the preferred embodiment, the flange 30 is about 1–2 mm. long, and is angled outward from the line described by the herringbone cuts 34 at about 10–30 degrees, preferably about 20 degrees. Collectively, the herringbone cuts 34 define a first taper relative to axis AA having an angle θ of about 10–40 degrees and preferably about 15–25 degrees. Expressed alternatively, the narrowest part of the taper should be about 20–50% less than the width of the label 30. The continuous cut 32 and plurality of herringbone cuts 34 together define a generally parabolic shape.

Next are a series of straight cuts 36 defining straight-side portions of the label 30. The number and length of these cuts is not critical, and in the preferred embodiment range from about 4–8 mm. in length, and total about 4–6 cm., or about 50% of the overall length of the coupon 30. Uncut substrate between cuts 36 can be very small, on the order of 0.5–1.0 mm. Intermediate to the herringbone cuts 34 and the straight cuts 36 is a transition cut 38. The transition cut 38 is coincident with and matches the direction of cut of adjacent cuts 34 and 36, thus facilitating a clean, even tear along a longitudinal tear axis AA by transitioning the lateral component of tearing force directed by the taper defined by the herringbone cuts 34, to a linear component along axis AA. It is also important that the flange 33 does not extend beyond the extended line formed by the straight cuts 36.

The coupon 30 is terminated by a plurality of overlapping vertical hash cuts 40, each about 4–6 mm. in length, at the end of the coupon 30 opposite to that of the continuous cut 32. The overlapping vertical hash cuts 40 are cut perpendicular to the axis AA and are staggered as shown in FIG. 2. Each hash cut 40 overlaps the adjacent cuts 40 by approximately 10–30% of the length of the cut 40. The vertical hash cuts 40 define a second taper, relative to a lateral axis BB, of approximately 5–10 mm. and form an angle α relative to axis BB of about 1–20 degrees, preferably about 5–15 degrees (thus 70–89, preferably 75–85 degrees, relative to AA). It is preferred that the angle α approach 0 degrees to yield a squared-off end when the coupon 30 is removed; yet some angle less than 0 degrees is required to redirect the applied tearing force (along axis AA) inwardly (parallel to axis BB). The overall length of coupon 30 comprising the taper defined by the hash cuts 40 is about 5–30% of the width of the coupon 30, and preferably about 10–20% of the width of coupon 30. The spacing (i.e. uncut substrate) between adjacent hash cuts 40 is important to the strength of the overall coupon 30 and should be about 0.5–2.0 mm., or approximately 10–40%, preferably 20–30% of the length of the cut 40. Intermediate to the staggered hash cuts 40 and the straight cuts 36 is another transition cut 38, which similarly provides the function of transitioning the tearing force from entirely linear, along line AA, to one having a lateral, inward component, along line BB. The taper defined by the staggered hash cuts 40 also permit the transition of the tear forces from linear to lateral along the lateral axis BB.

Referring again to FIG. 2, the label 10 does not require adhesive about its entire inner surface in order to be affixed to the container 12. Normally, adhesive is applied only about one or both of surfaces 42 or 44 defining a narrow strip at opposite ends of label 10. The label 10 may be designed such that the surfaces 42 and 44 overlap when the label 10 is affixed to and about container 12, and the adhesive secures surfaces 42 and 44 to each other, or the surfaces 42 and 44 may both be adhesively secured to the container 12, without overlapping. It is noted that surfaces 42 and 44 are depicted in FIG. 1 as being opposed; however, they may both be a part of the inner surface of label 10. Optionally, adhesive may be applied to any point on the inner surface of fixed portion 20. This absence of a requirement for adhesive about the entire inner surface of the label 10 provides a significant advantage in that, in addition to materials savings, the absence of adhesive allows additional printing on the inside of the coupon 30, the fixed portion 20, or both. It is also to be noted that, while the coupon 30 is depicted and described as being centrally located about the label 10, the invention as contemplated herein is not restricted to such a configuration as the ease of tearing the coupon 30 allows for the use of a label 10 which is not required to have a high tensile strength and, further, permits the coupon 30 to be located virtually anywhere within the limits of the label 10. Generally, the only limitation is that there be sufficient border between the perforations 38 and the edge of the label 10 such that the label 10 remains intact when the coupon 30 is removed. Typically, this distance is a minimum of 2 to 5 cm.

In another embodiment of the present invention, the coupon 30 may be made symmetrical about an axis parallel to axis BB. In such an embodiment the coupon would comprise two opposed sets of herringbone cuts 34, separated by a set of straight cuts 36 and transition cuts 38, and would terminate in a continuous cut 32 at each end. A further alternative would be to omit the straight cuts 36 and place the herringbone cuts 34 back-to-back separated by one set of transition cuts 38, to yield a generally double parabolic shape. Further, the continuous cut 32, while preferably arcuate, may be cut in another manner so long as the cut is continuous and nonlinear, i.e., not perpendicular to axis AA, and includes an angle or curve such that force exerted along the pull direction AA will be directed laterally along axis BB. Thus, this cut may be tapered and terminate in a point, for example, as a chevron. It is also within the scope of the present invention to omit the plurality of straight cuts 36 such that the herringbone cuts 34 and hash cuts 40 are separated by a single transition cut 38. In such an embodiment, the angle θ between axis AA and the herringbone cuts 34 would be smaller and the overall length of cuts 34 greater. The coupon as described herein may also be scaled up or down as known to the art, as long as the perforation pattern is maintained. It should be noted that the dimensions given herein are illustrative only, and when scaling up or down it is important only that relative dimensions are preserved.

The substrate material for the label 10 is generally a paper stock having a basis weight of approximately 10–60 pounds, preferably 30–50 pounds. A variety of basis weights of paper are suitable as known to the art; the only limitation, again, is that the stock possess sufficient mechanical strength when cut into labels. With a paper substrate, it is most preferred that axis AA be aligned with the machine direction, i.e. the direction of fiber orientation from the paper manufacturing process. Materials other than paper may also be suitable, for example, polyethylene, a polyethylene/paper laminate or metal foil or other pliable substrates having a thickness of about 10–80 mils, more preferably about 30–50 mils. It is also within the scope of the present invention to form the coupon 30 as part of a laminate structure comprising a carton or box.

The label 10 of the present invention is manufactured by any means known to the art to manufacture such labels having perforated portions cut therein. Preferably, a die cutting process is used wherein multiple coupons 30 are cut on sheets of stock, which are then cut to form individual labels 10.

The label 10 is affixed about a container 12 as illustrated in FIG. 1. The radius of the container 12 causes the coupon 30 to protrude slightly outward about continuous cut 32, thus affording the consumer a ready starting-point to tear the coupon 30. This is accomplished by a single, continuous pull along line AA. The coupon 30 will cleanly tear apart from the fixed portion 20 of the label 10, even though the label 10 is adhesively secured about only a small proportion of its overall length. Product usage and safety information which may be printed on the fixed portion 20 of the label 10 is preserved by the sharply defined release of coupon 30. The coupon 30 is then redeemed in the normal manner at checkout.

The coupon 30 is designed to be resistant to inadvertent tearing during product packaging, handling and storing. The most severe stresses occur during production, where, for example, one-gallon bleach bottles are collected and dropped into an erected case from a distance of approximately 20 inches. From there they are conveyed to a side leak inspection area, then to a case sealer.

A tensile strength test was developed to demonstrate the resistance of the coupon 30 to inadvertent tearing. This test approximates the effects of an actual drop on a production line. Labeled one-gallon bottles are dropped from a distance of 20 inches into a case which is placed on a plexiglas plate. To simulate the cushioning effect of an actual drop on a production line, the plexiglas plate is raised on two opposite edges and away from the actual bottle drop area. Approximately one thousand bottles were tested in this manner, and no failures were observed.

Labels of the present invention were tested in various plants on both a Krones labeler and a Standard-Knapp labeler. Production runs were observed, with particular attention paid to: label magazine pickup, label gluing, conveying, case drop, onside leak inspection, and case closure. Sample loads were shipped, and a complete inspection was made at the receiving site. No label quality problems were encountered in any of these operations.

While described in terms of the presently preferred embodiments, it is to be understood that such disclosure is not to be interpreted as limiting. Various modifications and alterations will no doubt occur to one skilled in the art after having read the above disclosure. Accordingly, it is intended that the appended claims be interpreted as covering all alterations and modifications as fall within the true spirit and scope of the invention.

What is claimed is:

1. A label comprising (a) a non-releasable fixed portion for affixing to a container: and (b) a releasable coupon portion defined by a series of perforations comprising:

(i) a first continuous cut;

(ii) a plurality of herringbone cuts adjacent to and coincident with the continuous cut, the herringbone cuts collectively defining, a first taper relative to a central tear axis, each herringbone cut including a flange portion cut into the non-releasable fixed portion, each said flange extending into the fixed portion by a length equal to about 20–50% of a length of the herringbone cut, said flange further being angled relative to said first taper by about10–30, degrees, each flange further extending beyond a start of a succeeding herringbone cut;

(iii) a plurality of overlapping vertical hash cuts defining a second taper relative to said tear axis;

(iv) a first transition cut intermediate to and coincident with said plurality of herringbone cuts and said plurality of hash cuts; and wherein the coupon portion is separable from the fixed portion by applying a unidirectional pulling force along said tear axis.

2. The label of claim 1 wherein the first continuous cut is an arcuate cut.

3. The label of claim 2 wherein the continuous cut has an arc of about 80–120 degrees.

4. The label of claim 1 wherein the label substrate is a paper, a foil, a polymeric material, or a laminate thereof.

5.The label of claim 1 wherein said first taper has an angle of about 10–40 degrees relative to said tear axis.

6. The label of claim 1 wherein said second taper defined by said plurality of hash cuts has an angle of about 70–89 degrees relative to said tear axis.

7. The label of claim 1 wherein said hash cuts overlap by about 10–30% of the length of each cut.

8. The label of claim 1 and further including (a) a plurality of straight cuts defining a lateral limit of the coupon, said straight cuts being parallel to said tear axis and intermediate to said plurality of herringbone cuts and said vertical hash cuts; and (b) a second transition cut intermediate to and coincident with the plurality of straight cuts and the plurality of vertical hash cuts.

9. A label comprising (a) non-releasable fixed portion for affixing to a container; and a releasable coupon portion defined by a series of perforations comprising:

(i) a first continuous cut;

(ii) a first and a second plurality of herringbone cuts, the first plurality of herringbone cuts being adjacent to and coincident with the first continuous cut, and collectively defining a first taper relative to a central tear axis, each herringbone cut including a flange portion cut into the non-releasable fixed portion, each said flange extending into the fixed portion by a length equal to about 20–50% of a length of the herringbone cut, said flange further being angled relative to the first taper by about 10–30 degrees, each flange further extending beyond a start of a succeeding herringbone cut, the second plurality of herringbone cuts collectively defining a second taper relative to said tear axis, the first and second plurality of herringbone cuts collectively defining a double parabola;

(iii) a second continuous cut adjacent to and coincident with the second plurality of herringbone cuts;

(iv) a transition cut intermediate to and coincident with said first and second plurality of herringbone cuts; and wherein the coupon portion is separable from the fixed portion by applying a unidirectional pulling force along said tear axis.

10. A label having a releasable coupon portion thereof, the label being formed of a label substrate having formed therein a perforated releasable coupon comprising:

(a) a first arcuate continuous cut;

(b) a plurality of herringbone cuts adjacent to and coincident with the continuous cut, the herringbone cuts collectively defining a first taper having an angle of about 10–40 degrees relative to a central tear axis, each herringbone cut including a flange portion cut into the non-releasable fixed portion, each said flange extending into the fixed portion by a length equal to about 20–50 % of a length of the herringbone cut, said flange further being angled relative to the first taper by about 10–30 degrees, each flange further extending beyond a start of a succeeding herringbone cut;

(c) a plurality of overlapping vertical hash cuts defining a second taper relative to said tear axis;

(d) a plurality of straight cuts defining a lateral limit of the coupon, said straight cuts being parallel to said tear axis and intermediate to said plurality of herringbone cuts and said vertical hash cuts;

(e) a first transition cut intermediate to and coincident with said plurality of herringbone cuts and said plurality of straight cuts;

(f) a second transition cut intermediate to and coincident with said plurality of straight cuts and said plurality of vertical hash cuts; and wherein the coupon portion is separable from the label substrate by applying a unidirectional pulling force along said tear axis.

11. A method of making a label having a non-releasable fixed portion and a preformed differential release coupon portion defined by a series of perforations, the method comprising (a) forming into a label substrate a first continuous cut;

(b) forming into the label substrate a plurality of herringbone cuts adjacent to and coincident with the continuous cut, the herringbone cuts collectively defining a first taper angled relative to a central tear axis, each herringbone cut including a flange portion cut into the non-releasable fixed portion, each said flange extending into the fixed portion by a length equal to about 20–50% of a length of the herringbone cut, said flange further being angled relative to the first taper by about 10–30 degrees, each flange further extending beyond a start of a succeeding cut;

(c) forming into the label substrate a plurality of overlapping vertical hash cuts defining a second taper relative to said tear axis;

(d) forming into the label substrate a first transition cut intermediate to and coincident with said plurality of herringbone cuts and said plurality of hash cuts; and wherein the coupon portion is separable from the fixed portion by applying a unidirectional pulling force along said tear axis.

12. In a packaging label formed of a thin, pliant material having a releasable portion formed integrally therein, the improvement comprising a label substrate having a perforated tear outlined defined by:

(a) a first continuous cut;

(b) a plurality of herringbone cuts adjacent to and coincident with the continuous cut, the herringbone cuts collectively defining a first taper, having an angle of about 10–40 degrees relative to a central tear axis, each herringbone cut including a flange portion cut into a label substrate, each said flange extending into the fixed portion by a length equal to about 20–50% of a length of the herringbone cut, said flange further being angled relative to the first taper by about 10–30 degrees, each flange further extending beyond a start of a succeeding herringbone cut, the herringbone cuts collectively defining a first taper relative to a tear axis;

(c) a plurality of overlapping vertical hash cuts defining a second taper relative to said tear axis;

(d) a first transition cut intermediate to and coincident with said plurality of herringbone cuts and said plurality of hash cuts; and wherein the coupon portion is separable from the label substrate by applying a unidirectional pulling force along said tear axis.

13. A laminated multi-ply container having a differential release coupon portion integrally formed about an outer ply of the container, the coupon portion being defined by a tear outline in said outer ply comprising:

(a) a first continuous cut;

(b) a plurality of herringbone cuts adjacent to and coincident with the continuous cut, the herringbone cuts collectively defining a first taper, having an angle of about 10–40 degrees relative to a central tear axis, each herringbone cut including a flange portion cut into a container portion of said outer ply, each said flange extending into the fixed portion by a length equal to about 20–50% of a length of the herringbone cut, said flange further being angled relative to the first taper by about 10–30 degrees, each flange further extending beyond a start of a succeeding herringbone cut;

(c) a plurality of overlapping vertical hash cuts defining a second taper relative to said tear axis;

(d) a first transition cut intermediate to and coincident with said plurality of herringbone cuts and said plurality of hash cuts; and wherein the coupon portion is separable from the container portion of said outer ply by applying a unidirectional pulling force along said tear axis.

* * * * *